United States Patent [19]

Dannoura

[11] Patent Number: 4,690,197

[45] Date of Patent: Sep. 1, 1987

[54] MOLTEN METAL POURING DEVICE

[75] Inventor: Sadayuki Dannoura, Ube, Japan

[73] Assignee: UBE Industries, Inc., Ube, Japan

[21] Appl. No.: 736,654

[22] Filed: May 21, 1985

[30] Foreign Application Priority Data

May 23, 1984 [JP] Japan ..... 59-102701
Dec. 19, 1984 [JP] Japan ..... 59-266232

[51] Int. Cl.[4] ..... B22D 17/12

[52] U.S. Cl. ..... 164/312; 164/342; 425/574; 425/586

[58] Field of Search ..... 164/113, 303, 304, 305, 164/312, 313, 314, 315, 316, 317, 318, 342; 425/574, 586

[56] References Cited

U.S. PATENT DOCUMENTS 3,826,302 7/1974 Wunder ..... 164/312
4,287,935 8/1981 Ueno et al. ..... 164/314

FOREIGN PATENT DOCUMENTS 58-55859 12/1983 Japan .

*Primary Examiner*—Nicholas P. Godici
*Assistant Examiner*—Richard K. Seidel
*Attorney, Agent, or Firm*—Claude A. S. Hamrick

[57] ABSTRACT

A molten metal pouring device of the type having a stationary cover die and a movable rejector die which, when joined and held securely together in the horizontal direction, define a die cavity, a reduced-diameter restricted portion in communication with the bottom of the die cavity and an enlarged-diameter vertical bore in communication with the lower end of the reduced-diameter restricted portion; a vertical pouring sleeve for containing molten metal to be forced into the die cavity; and a plunger capable of vertically reciprocating in the vertical pouring sleeve to force the molten metal into said die cavity, characterized in that a stepped portion is formed in the inner wall surface surrounding the vertical bore.

10 Claims, 14 Drawing Figures

MOLTEN METAL POURING DEVICE

BACKGROUND OF THE INVENTION

The present invention relates to a die casting apparatus.

Most of the conventional die-casting machines have been such that the direction in which a cover die and a rejector die are joined and held securely together is same as the direction in which the molten metal is forced into a cavity. But there have been recently devised and demonstrated die-casting machines of the type in which a cover die and a rejector die are held securely together in the horizontal direction while the molten metal is forced into the cavity from the lower end or bottom thereof, such die-casting machines being referred to as "horizontal die clamping and vertical molten metal pouring type die casting machines" in this specification.

The die-casting machines of the latter type have various advantages. First, the length of molten metal in a pouring or ladling sleeve is short before the molten metal is forced into the cavity so that the temperature drop of molten metal can be minimized. The surface of contact between molten metal and air is small and a lesser quantity of air is entrained in the molten metal when the latter is forced into the cavity so that the die castings have less porosity which results from gases in the pouring sleeve. When the molten metal has been completely filled into the cavity, an injection plunger remains in opposed relationship with the cavity so that the pressure can be effectively transmitted. However, there is the problem that when a molten metal is forced into a cavity, a temperature drop occurs and the molten metal is solidified along the inner wall surface of the pouring sleeve and the solidified metal intrudes into the cavity, resulting in the degradation of the quality of the die castings.

In view of the above, applicant has disclosed a die-casting method and a die-casting machine which can prevent the intrusion of solidified metal into the cavity in Japanese Published Patent No. 58-55895 (1983). In this die-casting machine, a cover die and a rejector die are fitted with two-split stationary sleeves whose lower ends are made into contact with a pouring sleeve which is forced upwardly. A vertically reciprocable plunger is fitted into the pouring or ladle sleeve in such a way that the injection cylinder of a vertical molten metal pouring unit causes vertical reciprocal movement of the plunger. A small-diameter restricted portion intercommunicates between the cavity defined by the cover and rejector dies and the bore of a stationary sleeve.

In operation, after the molten metal has been poured into the pouring sleeve, the latter is forced upward and into contact with the stationary sleeve. Thereafter the plunger is advanced so that the molten metal is forced through the bore of the stationary sleeve and the small-diameter restricted portion into the cavity. When the molten metal is being forced into the cavity, a shell or a thin film cylindrical solidified metal formed along the inner wall surface of the stationary sleeve is corrugated and compressed between the plunger and the stepped surface immediately before the small-diameter restricted portion so that the shell remains in the bore of the stationary sleeve and therefore can be prevented from intruding into the cavity. The die casting which has been ejected out of the cavity after the molten metal has been completely solidified is connected to the so-called "biscuit" of excess metal left above the plunger by a portion of solidified metal corresponding to the small-diameter restricted portion. The biscuit can be easily separated from the die casting by breaking the fine solidified metal portion corresponding to the small diameter restricted portion.

However, in the die casting apparatus of the type described above, when the pouring sleeve and the plunger are moved downward after the molten metal has been forced into the cavity, the "biscuit" is in intimate contact with the upper end surface of the plunger so that it is also moved downward in unison with the pouring sleeve. As a result, the "biscuit" is broken off from the fine solidified metal portion corresponding to the small-diameter restricted portion so that the die casting is ejected out of the cavity while the "biscuit" remains on the side of the pouring sleeve. According to the partial shot method whose objective is to attain satisfactory casting conditions based upon the observation of the flow of the molten metal in the cavity, the plunger is forced downward at a suitable time when the cavity is partially filled with the molten metal. In this case, the "biscuit" tends to be broken off of the fine solidified metal portion corresponding to the small-diameter restricted portion. Especially when the plunger is stopped in the pouring sleeve, the "biscuit" is always forced to move downward in unison with the pouring sleeve when the length of the portion of the biscuit remaining in the pouring sleeve is longer than the length of the stationary sleeve.

When the biscuit remains on the side of the pouring sleeve in the manner discribed, the new molten metal cannot be ladled into the pouring sleeve. Furthermore when the injection cylinder is caused to be inclined while the biscuit broken off from the fine solidified metal corresponding to the small-diameter restricted portion remains projecting beyond the pouring sleeve, the leading end of the biscuit projecting beyond the pouring or ladling sleeve strikes against the notched rim at the lower end of the stationary platen so that the injection cylinder cannot be inclined as desired. As a result, the portion of the biscuit extending out of the pouring sleeve must be cut off by using gasses and then the pouring sleeve is inclined to the ladle position. Thereafter the plunger is pushed upward so that the biscuit remaining in the pouring or ladle sleeve must be pushed out of it and removed. As a result, the efficiency of the die-casting operation is considerably degraded. Furthermore, with the biscuit extending from the pouring sleeve, when the plunger is forced upward while the pouring sleeve remains at its lowered position so as to push the biscuit out of the pouring sleeve, the leading end of the biscuit engages with the lower end surface of the small-diameter restricted portion of the cover die because the downward stroke of the pouring sleeve is short. It follows therefore that unless the biscuit is cut off by using gases, it cannot be removed out of the pouring sleeve.

Moreover, the conventional stationary sleeve has a completely cylindrical inner wall surface so that the space at which the shell remains is not sufficient in area. Furthermore, the shell has a tendency to move toward the small-diameter restricted portion so that there is a tendency for the shell to intrude into the cavity through the small-diameter restricted portion.

Still further, when molten metal injection has been carried out by using the conventional stationary sleeve having a completely cylindrical inner wall surface and then, if it has happened during injection that a considerably large molten metal piece is poured into the cavity of a mold, smooth flow of the molten metal will suffer interference from such solidified metal piece, thus inadequate filling of the mold cavity with molten metal results therefrom.

SUMMARY OF THE INVENTION

Accordingly, a main object of the present invention is to provide a die casting apparatus wherein there is provided a stationary sleeve which is able, during the process of pouring molten metal into a mold cavity, to hold within it solidified metal pieces which, would be generated in the pouring process, thereby enhancing efficiency of the work as well as improving quality of mold products.

Another object of the present invention is to provide a die casting apparatus which can prevent a shell from intruding into the cavity and can minimize the size of a solidified metal piece to as small as possible.

A further object of the present invention is to provide a die casting apparatus which can facilitate the separation of a die casting from the cavity.

To the above and other ends, briefly stated, the present invention provides a die casting apparatus of the type which has a cover die and a rejector die which when the cover and rejector dies are horizontally joined and held securely together define a die cavity, a small-diameter restricted portion in communication with the lower end of the die cavity, and an enlarged-diameter vertical bore in communication with the lower end of the small-diameter restricted portion, and in which the molten metal is forced into the cavity from a pouring or ladle sleeve, characterized in that a stepped portion formed of recessed or projected portions is formed in the surface surrounding the vertical bore.

The molten metal enters the recess or remains under the projected portion so that when the pouring sleeve is forced downward, a solidified metal piece remains with a die casting in the cavity.

The above and other objects, effects, features and advantages of the present invention will become more apparent from the following description of some preferred embodiments thereof taken in conjunction with the accompanying drawings.

DESCRIPTION OF THE PREFERRED EMBODIMENTS

Figure 1:
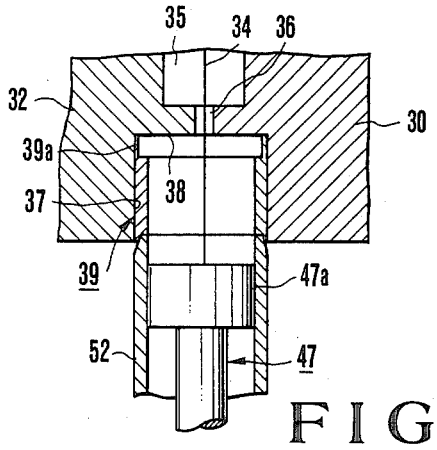
FIG. 1 is a longitudinal sectional view, on enlarged scale, of a portion below a cover and a rejector die of a die casting apparatus in accordance with the present invention.
Figure 2:
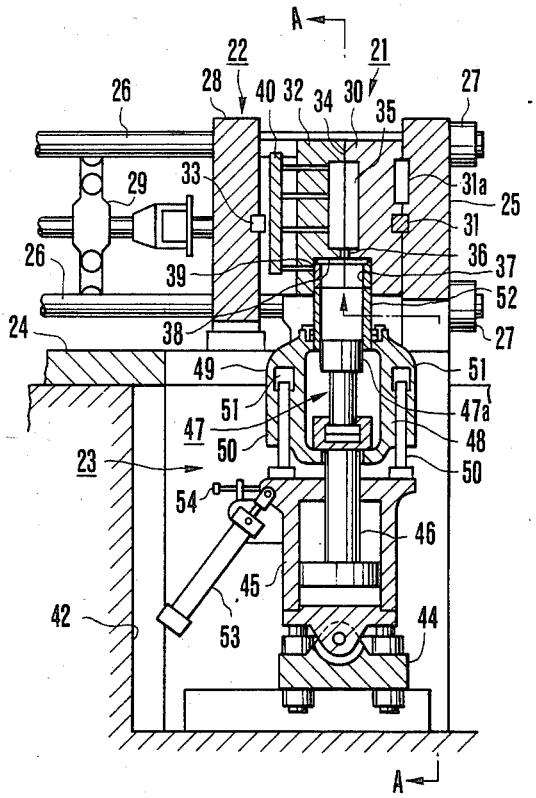
FIG. 2 is a longitudinal sectional view of a die-casting machine in accordance with the present invention.
Figure 3:
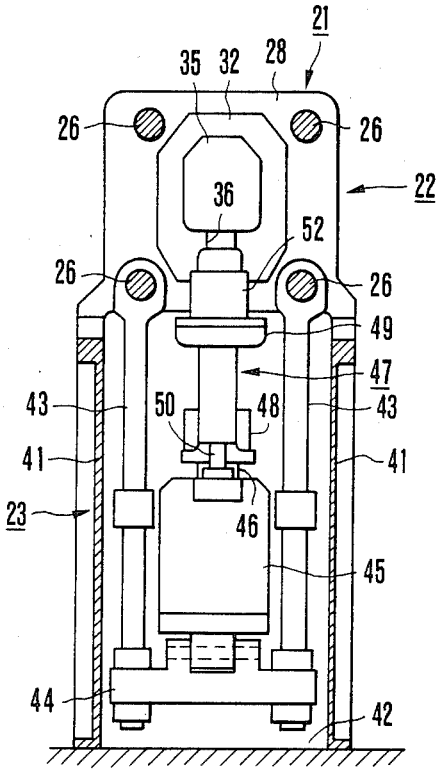
FIG. 3 is a sectional view taken along the line A—A of FIG. 2.

FIGS. 1-3 show a preferred embodiment of a die casting apparatus in accordance with the present invention. FIG. 1 is a sectional view, on enlarged scale, of a lower half or drag of a die; FIG. 2 is a longitudinal sectional view of a horizontal-clamping and vertical-pouring type die-casting maching to which is applied the present invention; and FIG. 3 is a sectional view taken along the line A—A of FIG. 2. A die-casting machine generally indicated by the reference numeral 21 has a horizontal clamping unit generally indicated by the reference numeral 22 and a vertical pouring unit generally indicated by the reference numeral 23. The horizontal clamping unit 22 has a machine base 24 securely mounted on a floor, a stationary platen 25 erected upright from one end of the machine base 24 and a movable end platen (not shown) positioned at the other end of the machine base 24. The opposing four corners of the stationary platen 25 and the end platen (not shown) are interconnected by means of columns 26 which in turn are securely held in position by means of nuts 27 so that a movable platen 28 which is carried by said four columns 26 may move toward or away from the stationary platen 25. The movable platen 28 is operatively coupled through toggle links 29 to a die clamping cylinder (not shown) disposed on the side of the end platen. Reference numeral 30 denotes a cover die whose vertical movement is restricted by means of a key 31 attached to the stationary platen 25 and which is located in the vertical direction of FIG. 2 by means of a key **31*a* disposed vertically at the center of the stationary platen 25. Reference numeral 32 denotes a rejector die which is prevented from moving vertically by means of a key 33 attached to the movable platen 28. The cover die 30 and the rejector die 32 are joined at the parting surface 34 and the rejector die 32 is movable toward or away from the cover die 30 in the horizontal direction. The reason why the vertical key 31*a* is disposed between the stationary platen 25 and the cover die 30 is that the transverse alignment of the cover die 30 with a molten metal pouring sleeve 52 of the vertical pouring unit 23 disposed below the parting surface 34 between the cover die 30 and the rejector die 32** can be made in a simple manner.

The cover die 30 and the rejector die 32 define a cavity 35 whose shape corresponds to that of a die casting, a restricted portion or orifice 36 at the bottom of and communicated with the cavity 35 and an enlarged diameter vertical bore 37 which is communicated with the restricted portion 36 and is extended downwardly with its lower end opened. The cavity 35, the restricted portion or orifice 36 and the enlarged-diameter vertical bore 37 are split along the parting surface 34. A shell contact surface 38 which is perpendicular to the parting surface 34 is defined between the restricted portion or orifice 36 and the vertical bore 37. A two-split stationary sleeve 39 is fitted into the vertical bore 37. An annular groove 39*a*, rectangular in cross section, is formed in the inner wall surface at the upper end of the stationary sleeve 39 so that when the molten metal fills the stationary sleeve 39, it may enter the groove 39*a*. Even when a plunger 47 is lowered after the solidification of the molten metal, the so-called "biscuit" of excess metal engages with the groove 39*a* so that it is prevented from being moved downward in unison with the plunger 47. An ejector 40 ejects the die casting out of the cavity 35.

The frame 41 of the vertical pouring unit 23 is disposed upright in a pit 42 below the die clamping unit 22 and supports the machine base 24. A pouring frame 44, which is disposed in the vicinity of the bottom of the pit 42, is connected by means of four supporting rods 43 to the lower columns 26. An ejection cylinder 45 which is pivotably carried on the pouring frame 44 has a piston rod 46 connected through a coupling 48 to a plunger 47. The piston rod 46 is caused to move upwardly or downwardly by the hydraulic pressure in the cylinder 45.

Figure 4:
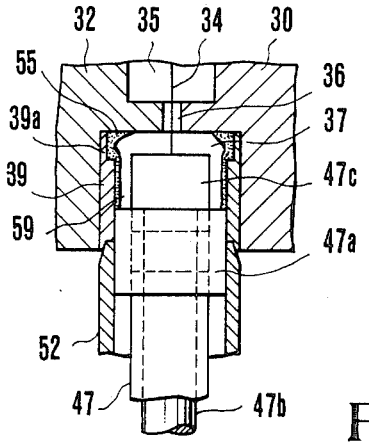
FIG. 4 is a view used to explain the mode of operation of a double-construction plunger of a molten metal pouring device in accordance with the present invention.

The plunger 47 is of double construction; that is, it has an outer plunger chip 47*a* and an inner plunger chip 47*c* as shown in FIG. 4.

The molten metal is poured or laddled into the sleeve 52 of the vertical pouring unit 23 by means of an inclining device, to be described hereinafter, and when the plunger 47 is moved upward, the molten metal is forced into the cavity 35. An outer plunger chip 47*a* formed integral with the upper end portion of the plunger 47 has a diameter substantially equal to the inner diameter of the pouring sleeve 52 and is adapted to make sliding contact with the inner surfaces of the pouring sleeve 52 and the stationary sleeve 39 as the plunger 47 moves upward or downward. The outer plunger chip 47*a* and the plunger 47 have a coaxial bore into which is slidably fitted an inner plunger 47*b*, as best shown in FIG. 4. An inner plunger chip 47*c*, which is in the form of a cylinder whose diameter is slightly smaller than that of the outer plunger chip 47*a*, is formed integral with the upper end of the inner plunger 47*b*. When the inner plunger chip 47*c* is at the lowest end of its stroke, the upper surface of the inner plunger chip 47*c* is coplanar with that of the outer plunger chip 47*a*. An oil chamber (not shown) is defined at the lower end of the bore of the plunger 47, and when the oil under pressure is forced into or discharged out of this oil chamber, the inner plunger 47*b* is forced upward or downward so that the inner plunger chip 47*c* is pushed upwardly of the upper surface of the outer plunger chip 47*a* or the upper surface of the inner plunger chip 47*c* becomes coplanar with that of the outer plunger chip 47*a*. In operation, the inner plunger chip 47*c* is so timed that when the plunger 47 forces the molten metal into the cavity 35, the inner plunger chip 47*c* is forced upwardly of the upper surface of the outer plunger chip 47*a*.

Referring again to FIG. 2 and FIG. 3, a block 49 is supported by means of a pair of rams 50 which are extended upright from the upper surface of the ejection cylinder 45 and are fitted into the ram holes in the block 49. The block 49 also has an opening formed through the bottom thereof and the piston 46 is fitted into this opening. When the oil under pressure is forced into the cylinders 51 in the block 49, the block 49 is caused to move upward and when the piston rod 46 is pushed downward, the block 49 is caused to move downward. A pouring sleeve 52 is securely fixed at the upper surface of the block 49 and is in the form of a cylinder whose diameter is equal to that of the stationary sleeve 39 and which is coaxial therewith. When the oil under pressure is forced into the cylinders 51 so that the block 49 is pushed upward, the pouring sleeve 52 and the stationary sleeve 39 are joined and pressed against each other in coaxial relationship and when the block 49 is caused to move downward, the sleeves 52 and 39 are separated from each other.

An inclining cylinder 53 whose base is pivoted to the frame 41 has a piston rod whose leading end is pivoted to the ejection cylinder 45. When the inclining cylinder 53 is energized when the block 49 is moved downward so that the sleeves 39 and 53 are separated from each other, the whole vertical pouring unit 23 swings between the pouring position shown in FIGS. 2 and 3 and the inclined position at which the molten metal is ladled into the vertical pouring unit 23. An adjusting stopper 54 is provided for engagement with the ejection cylinder 45 so that the pouring unit 23 is brought to its correct pouring position.

Next, the mode of operation of the die-casting apparatus with the above-described construction will be described. First, the stationary platen 25 and the movable platen 28 are fitted with the stationary cover die 30 and the movable rejector die 32, respectively, and then the piston rod of the die clamping cylinder (not shown) is extended so that the movable platen 28 is advanced through the toggle links 29 to close the die as shown in FIG. 2. In this case, the piston rod 46 of the ejection cylinder 45 is moved down to the position shown and the block 49 is moved down to the position lower than the position shown so that the sleeves 39 and 52 are separated from each other. Therefore, when the piston rod of the inclining cylinder 53 is extended, the whole vertical pouring unit 23 is inclined so that the pouring sleeve 52 is caused to move outward below the stationary platen 25 (to the right in FIG. 2). Then, the molten metal is poured into the pouring sleeve 52 with a ladle or the like and the inclining cylinder 53 is energized again so that the vertical pouring unit 23 is brought to its upright position. Thereafter the oil under pressure is forced into the cylinders 51 of the block 49 so that the block 49 moves upwards and the pouring sleeve 52 is pressed against the lower end of the stationary sleeve 39 in coaxial relationship.

Thereafter, the oil under pressure is forced into the ejection cylinder 45 so that the piston rod 46 is extended upwardly and the plunger 47 is also pushed upwardly through the coupling 48. Then the molten metal in the pouring sleeve 52 is forced into the cavity 35 defined by the dies 30 and 32 from the immediate lower end of the vertical parting surface 34 between the dies 30 and 32. In this case, the molten metal is also forced into the groove 39*a* in the stationary sleeve 39. Before the molten metal enters the cavity 35, part of the molten metal in contact with the inner wall surface of the pouring sleeve 52 is solidified so that a thin film of cylindrically configured solidified metal, or the so-called "shell" 59, is produced as shown in FIG. 4. When the plunger 47 is pushed upward, the shell 59 holds its cylindrical shape and is pushed upward by the outer plunger chip 47*a*. When the upper end of the shell 59 is made into contact with the shell contact surface 38, it is corrugated and compressed as the outer plunger chip 47*a* is forced upward. When the oil under pressure is forced into the oil chamber (not shown) in the plunger 47, the inner plunger 47*b* is forced upward so that the inner plunger chip 47*c* is extended upwardly beyond the upper surface of the outer plunger chip 47*a* to force the molten metal upwardly. Therefore, the outer plunger chip 47*a* has the function of only compressing the shell 59. In this case, the molten metal is gradually forced into the cavity 35 through the restricted portion or orifice 36 from the portion of molten metal most remote from the shell 59; that is, the upper portion at the center of the molten metal at which the temperature thereof is highest. When the plunger chips 47*a* and 47*c* reach their upper ends, the compressed shell 59 is trapped in a space 37 between the inner plunger chip 47*c* and the stationary sleeve 39. As a result, even when the plunger 47 is pushed to the uppermost position in order to minimize the amount of biscuit of excess metal of the die casting, the shell 59 is entrapped in the space 37 and is prevented from entering the cavity 35.

In this case, the compressed shell 59 enters the groove 39*a* formed at the upper end inner surface of the stationary sleeve 39 so that the volume for trapping the shell 59 can be maintained large. As a result, the shell 59 is prevented from entering the restricted portion of orifice 36. Should it happen that the shell 59 enters into the groove 39*a*, the shell would be broken a little, so that no significant problem would be caused from such shell's entrance into the groove 39*a*. Further, even if a broken piece of the shell 59 should jump into the mold cavity 35 through the restricted portion or orifice 36, no significant ill effect would be given to the quality of the product.

When the molten metal has been forced into the cavity 35 and solidified; that is, the die casting is produced, the working oil under pressures is discharged from the oil chamber (not shown) so that the inner plunger chip 47*c* is lowered and retracted into the outer plunger chip 47*a*. It should be noted that if the inner plunger chip 47*c* and the outer plunger chip 47*a* were lowered simultaneously, there would arise the problem that the shell 59 would be cut off at the upper end of the inner plunger chip 47*c* or the whole shell 59 would adhere to the inner plunger chip 47*c* and be moved downward in unison therewith. Therefore, after the inner plunger chip 47*c* has been lowered in such a way that the upper surface of the inner plunger chip 47*c* becomes coplanar with that of the outer plunger chip 47*a*, both the plunger chips 47*a* and 47*c* are pushed downward simultaneously. After the inner plunger chip 47*c* has been moved downward, the working oil under pressure is discharged from the cylinder 51 so that the block 49 is caused to move downward and the pouring sleeve 52 is separated from the stationary sleeve 39. Concurrently, the working oil under pressure is discharged from the ejection cylinder 45 so that the plunger 47 is moved downward. Thereafter the piston rod of the die clamping cylinder (not shown) is retracted so that the movable platen 28 is moved away from the stationary platen 25 to open the die and the die casting is ejected out of the cavity 35 by means of the ejector 40. Thus, one cycle of operation is accomplished. When the plunger 47 is moved downward before the die casting is ejected out of the cavity 35, the upper end surface of the outer plunger chip 47*a* is in intimate contact with the biscuit 55 resulting from the solidification of molten metal above the upper end surface of the outer plunger chip 47*a*. As a result, the biscuit 55 tends to move down in unison with the plunger 47, but in practice the shell 59 and the molten metal enter the groove 39*a* so that part of the biscuit 55 enters the groove 39*a* and the biscuit 55 is stepped. As a result, the biscuit 55 remains together with the die casting so that only the plunger 47 moves downward. As a result, the die casting which has been ejected out of the cavity 35 includes a narrow connecting portion corresponding to the restricted portion or orifice 36 and the biscuit 55. Therefore, the biscuit 55 can be easily separated from the die casting by breaking the narrow portion with a hammer or the like.

Figure 5:
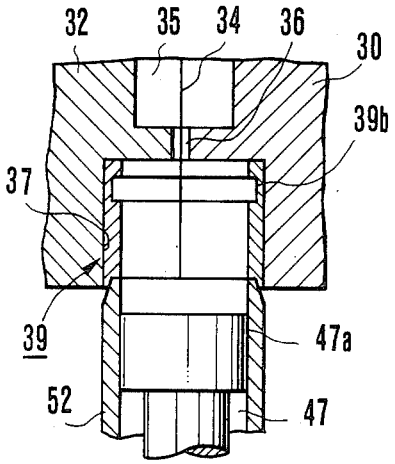
FIG. 5 is a longitudinal sectional view illustrating another embodiment of a groove in accordance with the present invention.

FIG. 5 is a view similar to FIG. 1 and shows in section another embodiment of a groove in accordance with the present invention. Unlike the first embodiment as shown in FIG. 1, a groove 39*b* has no opened top and is formed in the inner wall surface of the stationary sleeve 39 spaced apart by a suitable distance from the upper end thereof. The groove 39*b* has a uniform width and is annular. Like the first embodiment, the molten metal enters the groove 39*b* so that a biscuit remains integral with the die casting.

Figure 6:
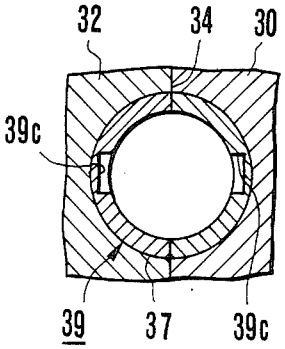
FIG. 6 is a cross sectional view illustrating a further embodiment of a groove in accordance with the present invention.

It is to be understood that alternatively a semicircular groove 39*b* may be formed in the inner wall surface of one of the two-split stationary sleeve halves 39 on the side of the cover die 30 and that grooves 39*c* may be formed only at desired portions of the inner wall surface of the stationary sleeve 39 as best shown in FIG. 6.

Various embodiments of a double-construction plunger may be proposed. In the first embodiment described above, the plunger 47 is provided with the outer plunger chip 47*a* and the inner plunger chip 47*c* so that the plunger 47 can be moved to the maximum highest position and consequently the thickness of the biscuit can be reduced.

In the first embodiment described above, when the inner plunger chip 47*c* is retracted downward, the upper end surface thereof is coplanar with that of the outer plunger chip 47*a*, but it is to be understood that even when the inner plunger chip 47*c* is retracted downwardly, it may remain normally extended beyond the outer end surface of the outer plunger chip 47*a*. In this case, when the inner plunger chip 47*c* is lowered to its lowermost position, the height of the inner plunger chip projected upwardly of the upper end surface of the outer plunger chip 47*a* may be substantially equal to the diameter of the inner plunger chip 47*c*. In this case, even before only the inner plunger chip 47*c* is moved upward in the last half of the molten metal pouring process, the shell 59 remains around the inner plunger chip 47*c* extended upwardly in unison with the upward movement of the plunger 47 so that the shell 59 can be prevented from entering the cavity 35.

Figure 7:
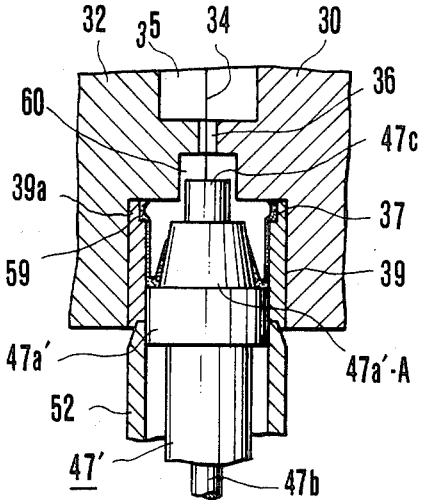
FIG. 7 is a longitudinal sectional view illustrating a further embodiment of a double-construction plunger in accordance with the present invention.

FIG. 7 is a sectional view of an embodiment of a double-construction plunger in accordance with the present invention. The upper half 47*a*'-A of an outer plunger chip 47*a*' of a plunger 47' is reduced in diameter and is tapered at an angle of 3°–5° and an engaging hole 60 into which is fitted an inner plunger chip 47*c*' is formed between the restricted or orifice portion 36 and the vertical bore 37. The upper half 47*a*'-A of the outer plunger chip 47*a*' is raised to the extended position of the inner plunger 47*c* of the first embodiment and the inner plunger chip 47*c*' is further pushed upwardly of this position into the engaging bore 60. Therefore, the upper half 47a'-A of the outer plunger chip 47a' has the same function with the inner plunger chip 47c of the first embodiment described above and the shell 59 is entrapped in the space defined between the upper half 47a'-A and the stationary sleeve 39. Since the upper half 47a'-A is tapered, it can be easily pulled out of the shell 59 when the plunger 47' is pushed downward. As a result, the shell 59 can be easily trapped. Almost all the molten metal in the stationary sleeve 39 is forced into the cavity 35 because the inner plunger chip 47c' is extended so that the amount of the biscuit can be minimized and therefore the yield of die castings can be improved.

Figure 8:
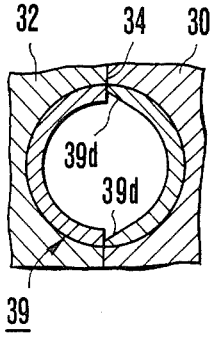
FIG. 8 is a cross sectional view of a modification of the present invention.
Figure 9:
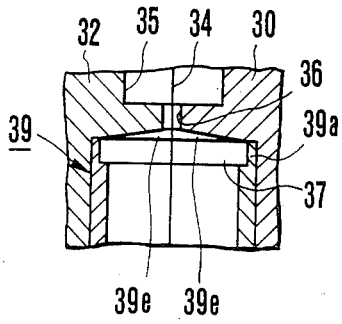
FIGS. 9, 10 and 11 are longitudinal sectional views, respectively, illustrating further modifications of the present invention.
Figure 10:
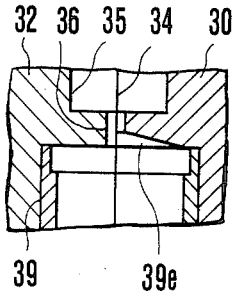
Figure 11:
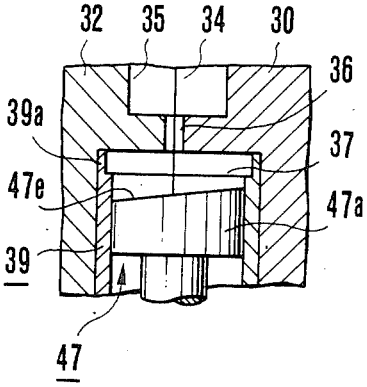

FIGS. 8, 9, 10 and 11 show additional preferred embodiments, respectively, of improvements for facilitating the separation of the two-split stationary sleeve halves 39. In FIG. 8, the ends of the inner surface on the side of the stationary cover die 30 are terminated in inclined or tapered surfaces 39d extended in the direction in which the tapered surfaces 39d are tangent with the bore. The inclined or tapered surfaces 39d may be extended wholly or partially along the stationary sleeve half 39 on the side of the cover die 30. In FIG. 9, the upper end of the vertical bore 37 is tapered as indicated by 39e. In FIG. 10, only one half of the upper end of the vertical bore 37 on the side of the stationary cover die 30 is tapered as indicated by 39e. In FIG. 11, the top end surfaces of the outer and inner plunger chips 47a and 47c are inclined upwardly toward the stationary cover die 30 as indicated by 47e. All the embodiments shown in FIGS. 8, 9, 10 and 11 can facilitate the separation of the die castings from the dies.

In the foregoing explanation of the embodiment, the plunger 47 has been defined as a plunger of the type wherein there are provided an outer plunger chip 47a and an inner plunger chip 47c, a so-called double construction plunger. However, it should be noted that the foregoing explanation shall not constitute any restriction over the plunger structure. Namely, the invention admits the use of an ordinary plunger provided with a cylindrical plunger chip.

Figure 12:
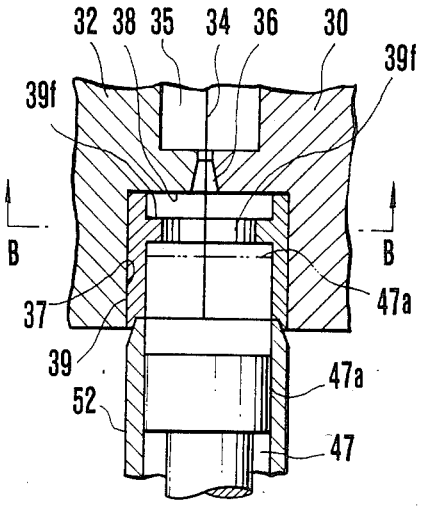
FIG. 12 illustrates a longitudinal cross sectional view of an stationary sleeve portion having an projected portion.
Figure 13:
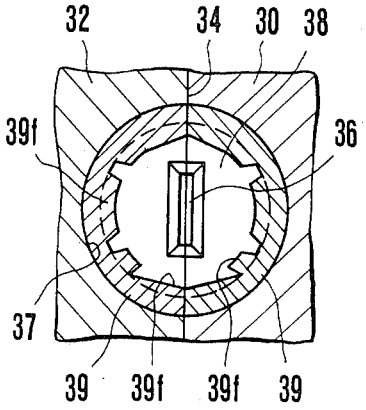
FIG. 13 is a cross sectional view taken along a line B—B in FIG. 12.

FIGS. 12 and 13 represent another embodiment of the invention wherein there is provided a projected portion 39f instead of recessed grooves 39a, 39b, and 39c.

In this case, the upper end of the shell 59 generated at the inner cylindrical surface of the stationary sleeve 39 is raised up in accordance with the progress of the injection process and comes up to abut against the lower surface of the projected portion 39f, and is eventually broken into a plurality of pieces. A part of the shell 59 in the broken state is further advanced across the projection 39f until it abuts against the plain portion 38 in front of the restricted portion 36.

Needless to say, the shape of the projection 39f need not be rectangular. A round or circular shape can be admitted. Further, the number of steps of the projection 39f and recessed grooves 39a, 39b, and 39c need not be single. It is allowed to take a multistepped structure. However, it should be noted, when providing the projected portion 39f, that the advancing limited line of the plunger chip 47a must exist under the projected portion 39f. This is shown with two dots chain line in FIG. 12. The shape of the restricted portion 36 may be of a truncated quadrilateral pyramid as shown in FIGS. 12 and 13.

Figure 14:
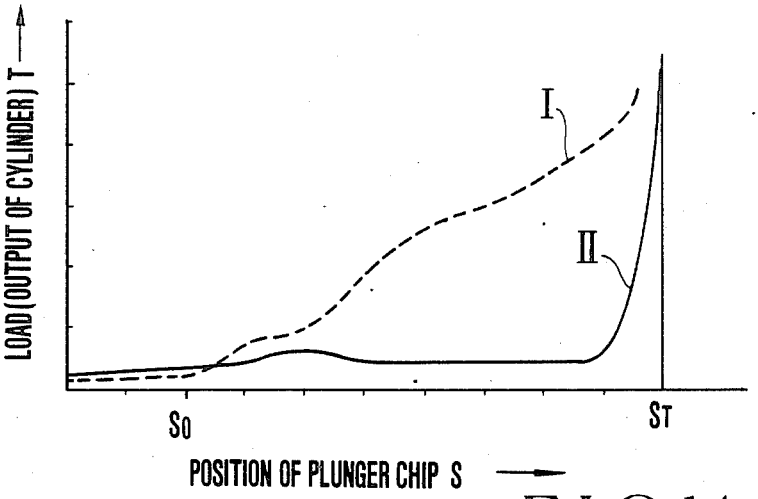
FIG. 14 is a graph showing the relation between a load and a plunger position, wherein a dotted line represents the case where no groove is provided in the stationary sleeve while a solid line represents the case where a groove is provided in the stationary sleeve.

FIG. 14 is a graph showing the relationship between the plunger chip position during injection operation and the load imposed then. The graph contains two cases, one of which is the case where the recessed groove 39b is not provided in the fixed sleeve 39 (i.e. conventional mode), while the other is the case where the recessed groove 39b is provided (i.e. the mode of the present invention). In the graph, the point $S_O$ is defined as the plunger chip point where the front of molten metal meets the shell abutting surface 38 which is the lower end of the restricted portion 36 of the mold. The upward position from this point shall be made plus while the downward therefrom minus. The load T represents the output of the injection cylinder.

As will be understood from the curve II in FIG. 14, the case in which the stationary sleeve 39 is provided in the recessed groove 39b as in the present invention, the load is hardly imposed on the plunger chip immediately before completion of filling the mold cavity 35 with molten metal (the fill-completion point is shown as ST), and then the load abruptly begins to increase until injection is complete. This is the most advantageous load characteristic line which can be achieved by the invention.

Contrary to the above advantageous load characteristic line, in the case of the conventional fixed sleeve 39 having no recessed groove 39b, as the curve I shows, the load begins to gradually increase as soon as molten metal comes into the mold cavity 35. The increased rate of the load in the conventional type is admittedly higher than in the present invention. Consequently, when the load has become maximum, the plunger chip 47 has not yet reached the position ST representing fill-completion. This implies that inadequate and incomplete filling of molten metal has happened in the mold cavity 35. In other words, this implies that an incomplete product containing at least an unmolded portion has resulted from the injection process. This undesirable state is often caused by a solidified metal lump with a considerably large size (i.e., shell 59) which has not arrested in the stage before the restricted portion 36 and has flowed into the cavity 35 to prevent the smooth flow of molten metal as well as the adequate transmission of injection power.

As has been explained above, according to the present invention, the stepped portion such as the recessed portion 39b provided in the stationary sleeve 39, can bring a lot of advantage such as smooth flow of molten metal during the injection process, prevention of intaking solidified metal into the mold cavity, assurance of product quality and so forth.

What is claimed is:

1. In a die casting apparatus of the type having a stationary cover die and a rejector die which is movable in horizontal direction to be joined with and separated from said cover die, said cover and rejector dies, when joined with each other securely, defining a die cavity having a small hole at a bottom thereof, a molten metal being injected into said die cavity from said hole to form a product, a vertical neck portion having a reduced diameter and an upper end communicated with said hole of the die cavity, and an enlarged-diameter vertical bore having an upper end communicated with a lower end of said neck portion and a lower end opened at the bottom surface of said cover and rejector dies; a vertical sleeve for containing said molten metal, an upper end of said vertical sleeve being adapted to the opened lower end of said vertical bore; and a plunger capable of vertically reciprocating in a bore of said vertical sleeve and said vertical bore to force the molten metal into said die cavity through said neck portion;

the improvement wherein a stepped portion is formed in an inner peripheral surface forming said vertical bore, and said inner peripheral surface is split into halves along the parting surfaces of said cover and rejector dies.

2. A die casting apparatus according to claim 1 wherein said stepped portion is a recess formed in said inner peripheral surface of said vertical bore.

3. A die casting apparatus according to claim 1 wherein said stepped portion is formed by an inwardly extending projection of said inner peripheral surface of said vertical bore.

4. In a die casting apparatus of the type having a stationary cover die and a rejector die which is movabe in horizontal direction to be joined with and separated from said cover die, said cover and rejector dies, when joined with each other securely, defining a die cavity having a small hole at a bottom thereof, a molten metal being injected into said die cavity from said hole to form a product, a vertical neck portion having a reduced diameter and an upper end communicated with said hole of the die cavity, and an enlarged-diameter vertical bore having an upper end communicated with a lower end of said neck portion and a lower end opened at the bottom surface of said cover and rejector dies; a vertical sleeve for containing said molten metal, an upper end of said vertical sleeve being adapted to the opened lower end of said vertical bore; and a plunger capable of vertically reciprocating in a bore of said vertical sleeve and said vertical bore to force the molten metal into said die cavity through said neck portion;

the improvement in said die casting apparatus comprising; a stationary sleeve which is split into halves along the parting surfaces of said cover and rejector dies and has an inner peripheral surface forming said vertical bore, an inner diameter of said stationary sleeve being substantially same as that of said vertical sleeve so that said plunger can pass upwardly through the bottom surface of said cover and rejector die without a reduction of a forcing pressure applied on said molten metal, a stepped portion being formed in the inner peripheral surface of said stationary sleeve.

5. A die casting apparatus according to claim 4 wherein said stepped portion is a recess formed in said inner peripheral surface of said stationary sleeve.

6. A die casting apparatus according to claim 5 wherein said recess is annular in configuration.

7. A die casting apparatus according to claim 6 wherein said annular recess is rectangular in cross-section.

8. A die casting apparatus according to claim 4 wherein said stepped portion is formed by an inwardly extending projection of said inner peripheral surface of said stationary sleeve.

9. A die casting apparatus according to claim 8 wherein said projection is annular is configuration.

10. A die casting apparatus according to claim 9 wherein said annular projection is rectangular in cross-section.

* * * * *